United States Patent [19]

Contini

[11] 4,354,478

[45] Oct. 19, 1982

[54] COOKING HOB, PARTICULARLY FOR BUILT-IN ASSEMBLY

[75] Inventor: Giorgio Contini, Guastalla, Italy

[73] Assignee: Societa per Azioni Technogas Fabbrica Apparecchiature Termo-Electrodomestiche di Giorgio e Gianni F. llt Contini, Gualtieri, Italy

[21] Appl. No.: 111,803

[22] Filed: Jan. 14, 1980

[30] Foreign Application Priority Data

Feb. 2, 1979 [IT] Italy ..... 46815 A/79

[51] Int. Cl.[3] ..... F24C 3/00

[52] U.S. Cl. ..... 126/39 E; 126/40

[58] Field of Search ..... 126/39 E, 39 R, 273 E, 126/275, 27, 29, 39 B, 39 C, 40, 42, 30, 9 R, 9 B; 108/40, 47, 46

[56] References Cited

U.S. PATENT DOCUMENTS

| | | | |
|---|---|---|---|
| 1,187,664 | 6/1916 | Sichel | 126/29 |
| 1,986,017 | 1/1935 | Schneider | 126/39 E |
| 2,107,972 | 2/1938 | Antrim et al. | 126/39 |
| 2,915,960 | 12/1959 | McClellan, Jr. | 126/273 A |
| 3,130,719 | 4/1964 | Mayer et al. | 126/39 R |

*Primary Examiner*—Daniel J. O'Connor

*Attorney, Agent, or Firm*—Brisebois & Kruger

[57] ABSTRACT

A cooking hob of small thickness for built-in assembly into cabinets, constituted by a box casing in which are disposed one or more gas burners which, with the aid of suitable ceramic blocks, constitute a like number of heat-insulating rigid bridges for connection between the upper drip plate and the lower plate or base of the box casing, and further comprising devices for quick coupling to the cabinet, constituted by a U bracket which encloses a threaded pin, and which during tightening moves from a disengagement position to an engagement position.

8 Claims, 10 Drawing Figures

Figure 1:
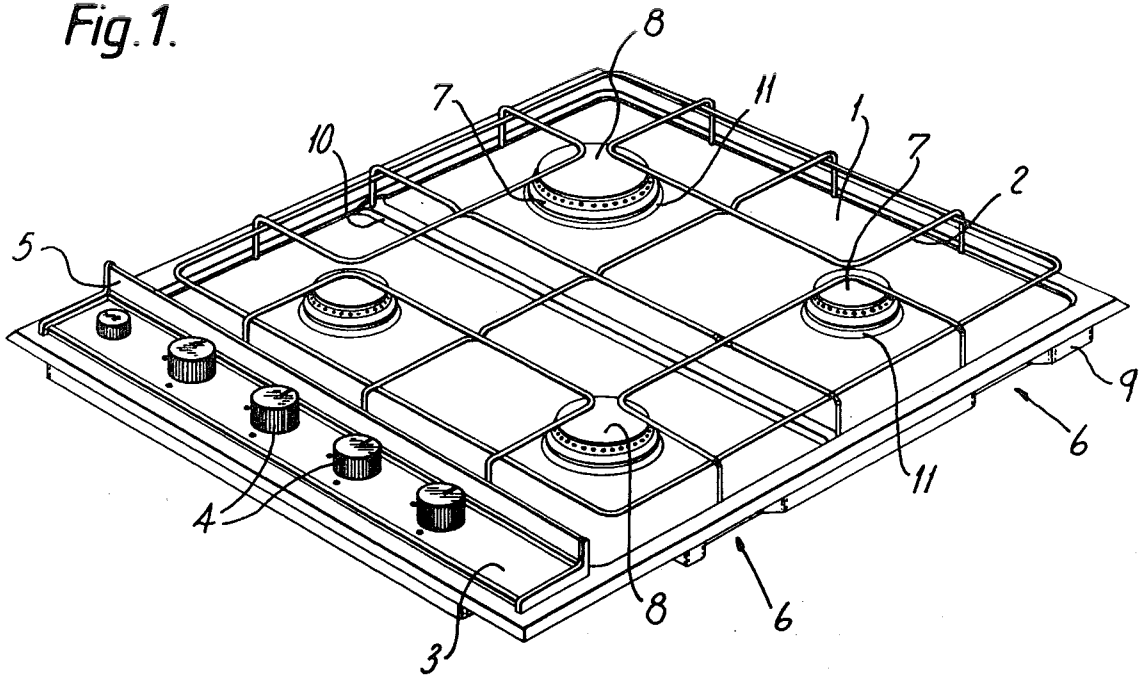

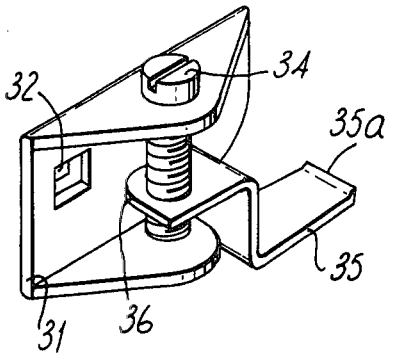
Fig.7.
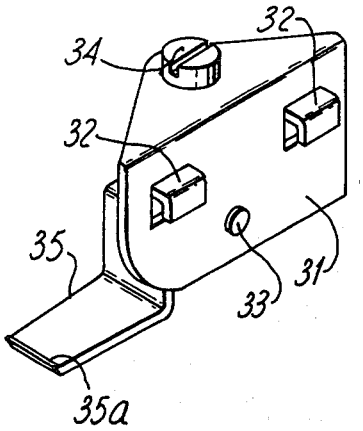
Fig.8.
Fig.9.
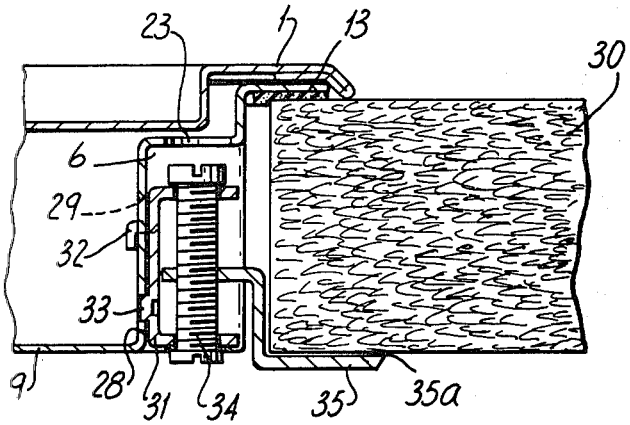
Fig.10.
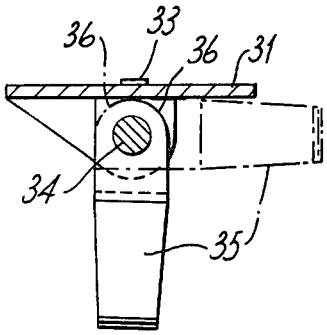

COOKING HOB, PARTICULARLY FOR BUILT-IN ASSEMBLY

This invention relates to an improved cooking hob which is of very limited thickness and is equipped in such a manner as to enable it to be easily and rapidly built into the top of the corresponding housing cabinet.

Cooking hobs are becoming increasingly more used in modern kitchen furnishing systems, because of their low cost and overall size relative to the normal domestic cookers.

The cooking hobs normally available commercially are usually constituted essentially by a lower box casing for containing the gas taps and conduits and the corresponding burners, and an upper cover or drip plate resting on the perimetral edge of the box casing, and on which a set of gas rings is disposed. An electrical hot plate is sometimes provided between these gas rings. Finally, known cooking hobs are provided with a suitable control panel for receiving the gas tap knobs and other controls, and is disposed either on the front horizontal edge of the drip plate or on one of its horizontal side edges.

These known hobs are usually designed for building into the tops of the normal cabinet units used for furnishing kitchens. Briefly, this built-in assembly comprises forming a suitable aperture in the corresponding top, then positioning the lower box casing of the cooking hob in said aperture so that only the gas rings and support grid for the cooking utensils project above the top of the cabinet. However, the increasingly widespread use of these cooking hobs has brought to light certain drawbacks which are listed hereinafter.

A first drawback derives from the fact that known cooking hobs have an excessive thickness, because of which they are poorly suitable for building into the cabinet tops, as they then project into the internal compartment of the cabinet. This drawback arises for example in the case of cabinets for housing a dishwasher. Other similar cases are cabinets for housing a washing machine or a small refrigerator. This is because in such cases the domestic appliance completely occupies the interior of the corresponding cabinet, because of which a known cooking hob cannot be built into its top because of the excessive thickness of the hob. Moreover, at the present time the dimensions of kitchen cabinet units and of the domestic appliances, particularly their height, are standardised at certain measurements for determined reasons, for example to facilitate unit assembly and in particular to obtain perfect coplanarity between the various tops when a number of cabinets are mounted side-by-side.

In the case of cabinets used simply for containing domestic utensils, a known cooking hob can certainly be built into their top, but because of its relatively large thickness it occupies part of the upper region of the cabinet, so limiting its capacity. This also leads to annoyance or obstacles in utilising said upper region of the cabinet.

Further drawbacks arise from the fact that known cooking hobs comprise excessively complicated devices for fixing them to the top of the corresponding cabinet, consequently requiring long and uncomfortable assembly operations.

These assembly operations, and the dismantling operations necessary for example for checking, overhaul, adjustment or replacement, normally have to be carried out from below, i.e. from the inside of the cabinet, which is very uncomfortable if the cabinet has another device such as a dishwasher built into the front of it. All the aforesaid drawbacks can obviously be obviated by reducing the thickness of the cooking hob to the thickness of the top of the cabinet into which said cooking hob is to be built in, i.e. about 3 cm (three centimeters) in the case of the standardised dimensions at present in force.

However, the mere reduction in thickness of known cooking hobs has not as yet been possible without serious drawbacks.

In this respect, in known cooking hobs, the burners are fixed to the underneath of the upper plate, and are required to remain separated from the lower plate of the box casing which contains them. However, the heat and mechanical deformation of said upper plate often brings the burners into contact with the lower plate.

Because of this, when these contacting burners are operating, they transmit heat to said box casing and thus heat it, said transmission being rapid and considerable in that the elements in contact are constructed of metal. Said box casing can then reach a temperature, especially with prolonged burner operation, which is incompatible with anything which is in direct contact with it or in its immediate vicinity.

If this temperature exceeds 60° C., then another machine such as a refrigerator or dishwasher cannot be built into the front of the same cabinet.

For these and other reasons, in particular in order to prevent bending of the drip plate and the consequent lowering of one or more burners, the drip plate is often constructed of relatively thick sheet metal and is provided with a plurality of drawn ribs. Said ribs are necessary in order to keep the drip plate flat even when not loaded, in order to prevent it from deforming by the effect of heat.

The necessary presence of the drawn ribs prevents the total thickness of the hob being contained within the required 3 cm, and is also uncomfortable for cleaning the upper plate.

The main object of the present invention is to provide an improved cooking hob particularly for built-in assembly, in which the aforesaid drawbacks are obviated by means of a constructionally simple and rational design.

According to the invention, the cooking hob is of the type comprising a lower box casing for containing the burners and their gas taps and conduits, and an upper drip plate in the centre portion of which a series of gas rings is disposed and at the periphery of which a suitable control panel is disposed, the thickness of the lower box casing and the relative drip plate being about 3 cm, wherein the drip plate is directly connected, by way of each individual burner, to the underlying box casing in such a manner that said burner forms part of a rigid connection bridge which ensures consistency between the drip plate and the box casing, so preventing them from deforming relative to each other.

Suitable refractory members are disposed between the drip plate and burners and between the burners and the box casing in order to thermally insulate the said elements. In the vertical lateral edges of said box casing there are provided suitable recesses, each for receiving a suitable device which allows quick coupling to the corresponding top of a cabinet, said device being able to be operated either from below or above this cabinet top. The said insulating members are preferably constituted by suitable gaskets disposed between the burners and drip plate, and ceramic blocks between the burners and the box casing, these blocks receiving the appendices which branch laterally from the corresponding burner.

According to the invention, said quick coupling devices consist of a bracket provided with hooks for connecting to the rear wall of the corresponding recess, a vertical threaded member being mounted rotatable relative to the bracket arms and comprising screwed thereon a profiled tooth provided with an anti-rotational positioning stop.

Figure 2:
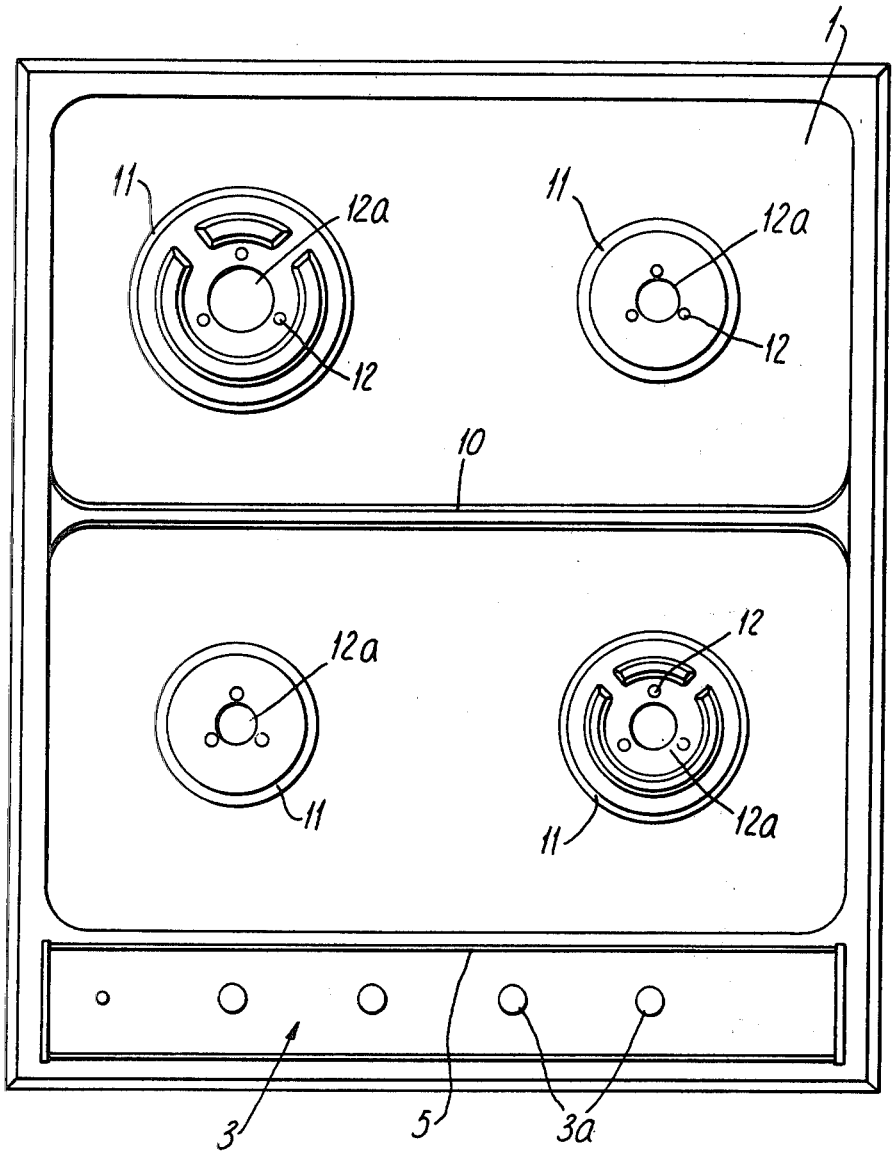
Figure 3:
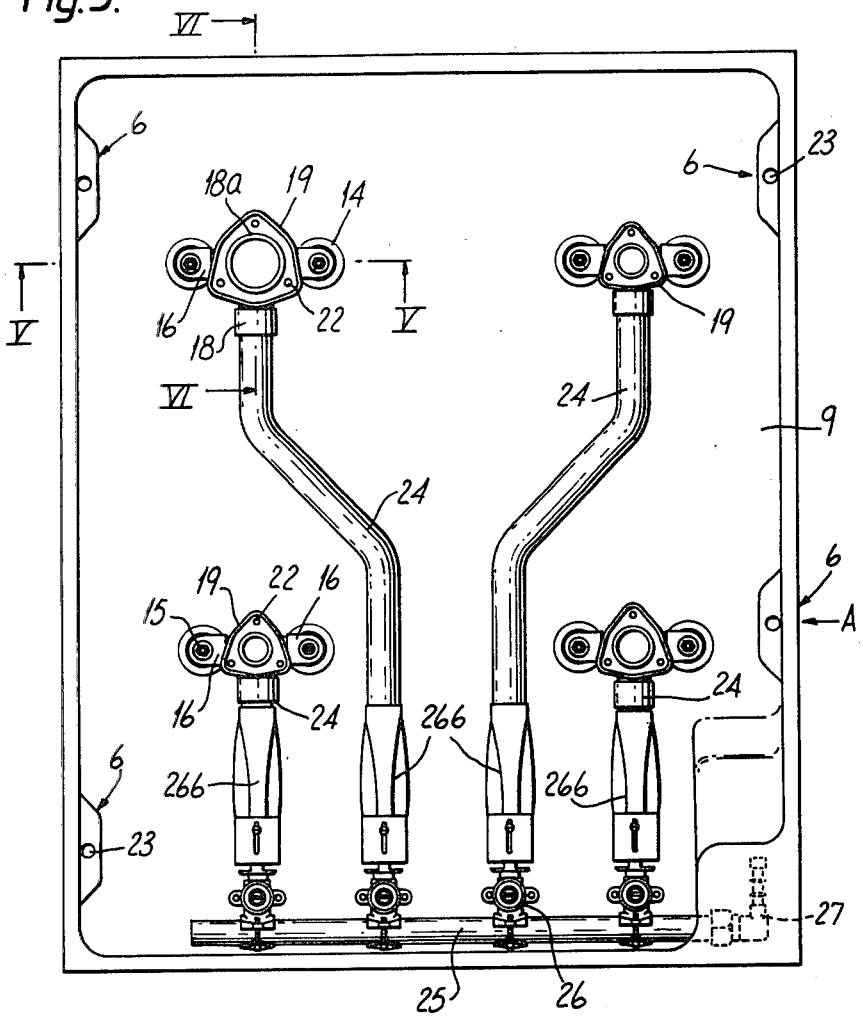
Figure 4:
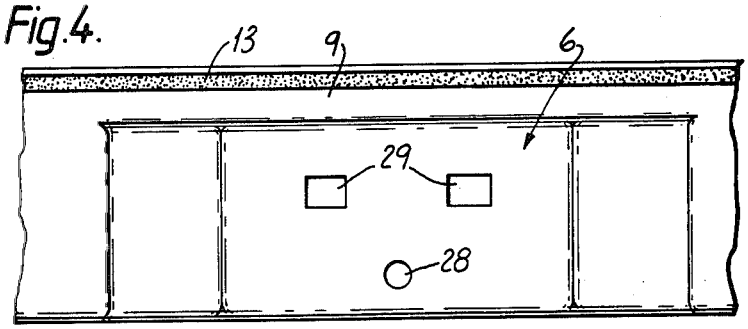
Figure 5:
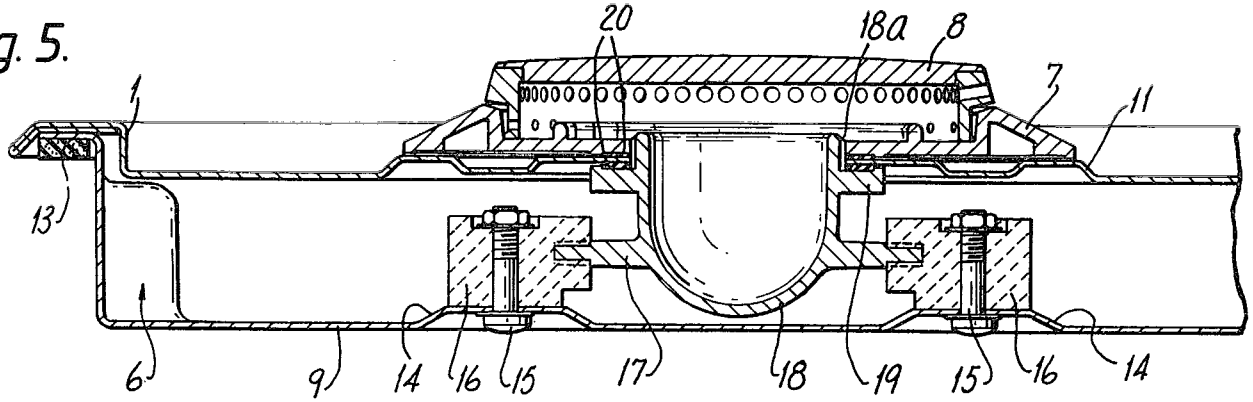
Figure 6:
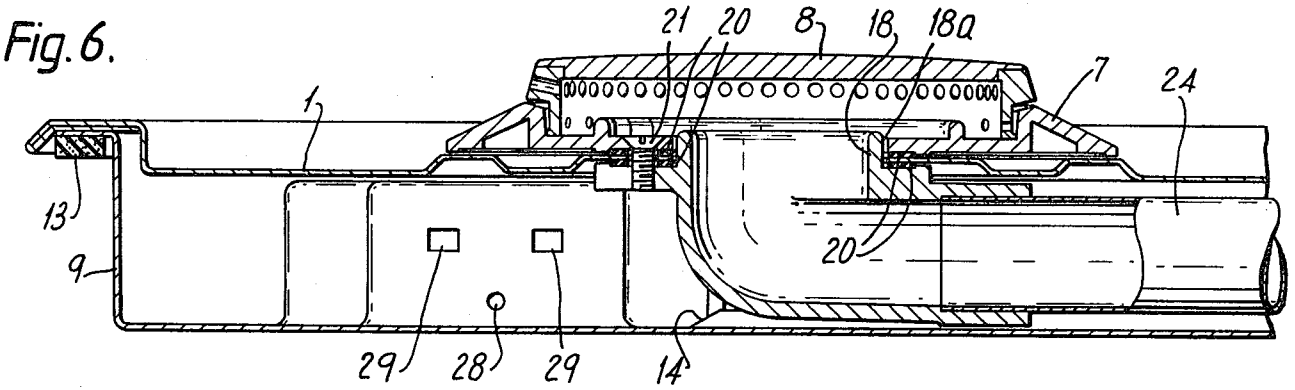

The objects and advantages of the invention, together with its operational characteristics and method of use, will be more apparent from the detailed description given hereinafter with reference to the figures of the accompanying drawings which show one preferred embodiment thereof by way of non-limiting example, and in which:

FIG. 1 is a perspective view of the present invention,

FIG. 2 is a plan view of the invention without the upper part of the burners, FIG. 3 is a plan view showing the interior of the cooking hob according to the invention, from which the upper drip plate has been removed, FIG. 4 is an external side view of one of the recesses provided in the box casing of the invention, taken in the direction of the arrow A of the preceding figure, and to an enlarged scale, FIGS. 5 and 6 are sections on the lines V—V and VI—VI of FIG. 3 respectively, FIGS. 7 and 8 are a front perspective view and a rear perspective view respectively of the coupling device for locating in the recess of FIG. 4, FIG. 9 is a vertical broken view showing said device in the position in which it fixes the cooking hob, and FIG. 10 is a plan view showing the two end positions, namely the fixing and release positions, of the aforesaid coupling device.

Said figures, and in particular FIG. 1, show that the improved cooking hob according to the invention comprises a drip plate 1, which rests by its perimetral edge on the corresponding horizontal perimetral edge of a lower box casing 9, for containing the gas burners, conduits and taps as will be described hereinafter. Said drip plate 1, of usual shape, is traversed by a slight central depression which is slightly below the plane of said perimetral edge. The drip plate 1 is constructed from a thin sheet of stainless steel for the reasons which will be specified hereinafter.

The drip plate 1 is traversed by a small transverse rib 10, the upper wall of which is slightly below the perimetral edge of the drip plate. In the depression in this latter, there are provided four circular drawn portions 11 standing in slight relief and of different diameter, for receiving four gas rings. In this respect, a head 7 and a diffuser disc 8 are disposed on the upper wall of each drawn portion 11. The perimetral corner of the depression provided in the drip plate 1 receives the base bar of a normal grid 2, the upper bars of which are disposed above the said gas rings.

In the front region of the drip plate 1 there is disposed a control panel 3 for receiving the operating knobs 4 for said gas rings and possibly other controls, and to the rear of which there is a raised portion 5, the purpose of which is to protect the controls on the panel 3 from the heat of the operating gas rings.

FIG. 1 also shows that suitable recesses 6 are provided in the vertical side edges of the box casing 9, and are described hereinafter.

Referring to FIG. 2, it can be seen that the base wall of the panel 3 is provided with a series of through bores **3*a* for traversing by the controls disposed on the panel 3**.

From FIG. 2 it can also be seen that in the centre of each drawn portion 11 of the drip plate 1 there is provided a through bore **12*a*, external to which there are provided three small through bores 12** radially equidistant.

From FIG. 3 it can be seen that the upper horizontal wall of each recess 6 is provided with a through bore 23. From the same figure it can be seen that in proximity to the front edge of the box casing 9 there is a gas manifold 25 to which four taps 26 for the gas rings of said cooking hob are connected.

The manifold 25 emerges from the box casing 9, but without extending beyond its transverse limits, in order to receive a connector 27 for connection to the domestic gas system.

As clearly shown, this connector 27 is housed in a suitable recessed seat provided at the front right hand corner of the box casing 9.

From each tap 26 there branches a venturi mixer tube 266 which extends into a conduit 24 which feeds the corresponding burner. As can be seen in FIG. 4, the vertical side wall of each recess 6 is provided with two rectangular apertures 29 above a circular centering bore 28. FIG. 4 also shows that the apertures 29 are symmetrical about the axis of symmetry of said recess, and the centering bore 28 lies on said axis of symmetry.

From FIGS. 5 and 6, it can be seen that each gas conduit 24 is inserted into the corresponding burner 18 which, as shown in FIG. 6, is configured in the manner of a smoker's pipe so as to have an extremely small vertical dimension. On the side of each pipe burner 18 there are provided small outer vertical ribs 18A in order to facilitate correct positioning of the corresponding burner head 7 relative to its outlet mouth.

Said burner head 7 is externally of cone frustum shape, and is provided internally with a cylindrical seat provided at its base with a circumferential rib, and a set of three flared through bores (FIG. 6).

Each burner 18 is provided on its outside below the centering ribs **18*a* with a perimetral flange 19 which when viewed in plan, as shown in FIG. 3, is of polygonal shape. The upper face of the flange 19 is provided with a slight groove into which a suitable gasket 20 is inserted. This gasket, which is of asbestos or another equivalent insulating material, has a thickness slightly greater than the depth of the corresponding groove provided in the flange 19**.

The lower face of the corresponding drawn portion 11 rests on the upper face of this insulating gasket 20 such that the sheet metal forming the drip plate 1 is slightly spaced apart from the horizontal perimetral edge of the flange 19.

As clearly shown in said figures, said flange 19 is provided with a set of three threaded bores 22 (FIG. 3). Moreover, even though not shown, the lower face of the base of the inner cylindrical seat of each head 7 of the burners has a configuration which when viewed in plan practically coincides with the configuration of the corresponding flange 19 of the burner 18. Consequently, the lower face of said head 7 of the corresponding burner is provided with a groove into which a further gasket 20 is inserted. This latter, of asbestos or another equivalent material, has a thickness slightly greater than the depth of the groove in the inner circumferential rib of the head 7, such that this latter is displaced slightly from the upper face of the drawn portion 11. This pair of gaskets 20 is provided with a set of three through bores which, when the gas ring is mounted, are aligned with the corresponding three flared bores in the flat base of the head 7, with the three through bores 12 in the drawn portion 11, and with the three threaded bores 22 provided in the corresponding flange 19. In this manner, said elements 7, 1 and 19 are rigidly connected together by a suitable set of flared head tightening screws 21.

From said FIGS. 5 and 6, it can also be seen that the through bores 12 in the drip plate 1 have a diameter slightly greater than the diameter of said screws 21.

Moreover, even though not shown, the inner diameter of the circumferential rib of the head 7 is slightly greater than the outer diameter of the mouth of the corresponding pipe burner 18.

The through bore **12*a* in the corresponding drawn portion 11 has a diameter slightly greater than the outer diameter of the burner mouth 18**.

Two horizontal appendices 17 branch from the outer lower regions of each burner 18, and are disposed substantially symmetrical about the longitudinal plane of symmetry of the burner 18. The free ends of these appendices 17 are embedded in an insulating block 16 of ceramic or another equivalent material, fixed by a pair of bolts 15 to the base wall of the box casing 9.

In order to prevent any projection below the base wall of the box casing 9, this latter is provided with suitable drawn portions 14 for containing the heads of said bolts 15.

From FIGS. 5 and 6 it can also be seen that a suitable resilient gasket 13 is provided below the horizontal perimetral edge of the box casing 9.

One of the quick coupling devices which are individually housed in each of the recesses 6 in the box casing 9 of the cooking hob will now be described with reference to FIGS. 7 to 10. As shown in FIGS. 7 and 8, this quick coupling device consists essentially of a U bracket 31, the base wall of which is provided with two hooks 32 facing downwards for insertion into the apertures 6, and a centering stem 33 for insertion into the corresponding centering bore 28 in the inner wall of the corresponding recess 6. Consequently, even though not previously stated, said hooks 32 and stem 33 lie on the outer face of the base wall of the bracket 31. A threaded pin 34 is rotatably mounted through the arms of the bracket 31, and is provided with two opposing heads disposed on the outside of said arms of the bracket 31. As clearly shown, each of these heads is provided with a diametrical slot for receiving the blade of a screwdriver. The central part of the threaded pin 34 is screwed through a profiled tooth 35 of step shape. The free end of the profiled tooth 35 comprises a non-slip lip **35*a*. From the illustration, it is apparent that the profiled tooth 35 is constructed by bending a metal plate which has one corner 36 rounded on the horizontal portion of the profiled tooth 35. Said rounded corner 36 is disposed to the rear for clockwise rotation of the threaded pin 34, this direction of rotation causing the pin 34 to screw into the profiled tooth 35 so as to pull it upwards. In contrast, the lower arm of the bracket 31 is shaped such that during anti-clockwise rotation of the threaded pin 34, the profiled tooth 35 rests against the base wall of the bracket 31 so that it completely lies within the transverse dimensional limits of said bracket 31. In this respect, as can be seen in FIG. 9, in said position the profiled tooth 35 is completely housed, together with the corresponding bracket 31, within the recess 6 so that it in no way impedes the insertion of the cooking hob 9 into the corresponding aperture provided in the top 30** of a normal kitchen cabinet.

The advantages of the cooking hob according to the invention are apparent from the aforegoing description, and are summarised hereinafter.

Firstly, the thickness of that part of the cooking hob lying below its perimetral edge which rests on the housing top 30 is extremely small, of the order of 3 cm, because of which the cooking hob can be built into the top of any kitchen cabinet. This small thickness is made possible by the rigidity and consistency of the entire cooking hob according to the invention. For this reason, the cooking hob according to the invention can be built into the top of a normal cabinet designed for containing foodstuffs or kitchen utensils, and, more advantageously, can be built into the top of those cabinet housings for containing domestic appliances such as a dishwasher, washing machine or a small refrigerator.

Because of the special technical and constructional characteristics of the cooking hob according to the invention, the box casing 9 is prevented from attaining a temperature exceeding 60° C., which could be damaging to machines which are fitted closely below the top 30.

Finally, the rational coupling devices with which the cooking hob according to the invention are equipped enable this latter to be quickly and easily fixed to the top 30 of the corresponding cabinet, after the top 30 has been provided with a suitable aperture for receiving the bottom of the cooking hob. In this respect, these coupling devices can be operated either from above or from below, but obviously operation from above is always more simple and rapid. This operation from above is particularly advantageous when the cooking hob is to be built into the top 30 of a cabinet for housing a domestic appliance which, as normally happens in the known art, occupies practically the whole of the interior of said cabinet. The great advantages of such coupling devices become extremely important when the cooking hob has to be dismantled and remounted for overhaul, adjustment and/or replacement of faulty or damaged members.

The cooking hob according to the invention is built into the corresponding aperture in the top 30 of a normal kitchen cabinet in the following manner. The screws 21 are firstly removed in order to separate the drip plate 1 from the box casing 9. Then, after checking that the hooks 32 of the brackets 31 are inserted into the apertures 29 and the centering stems 33 are thus also inserted into the centering bores 28 of the recesses, the threaded pins 34 are rotated with a screwdriver through the through bores 23 in the box casing 9, so that the profiled teeth 35 are brought into contact with the base wall of the corresponding bracket 31.

In this manner, the profiled teeth 35 are made to lie within the lateral dimensional limits of the box casing 9, so that this latter can be easily inserted into the aperture in the top 30, against which the box casing 9 rests by way of the resilient perimetral gasket 13.

The threaded pins 34 are then rotated in the opposite direction through the through bores 23 in the box casing 9, with the result that the corresponding profiled teeth 35 rotate rigidly with these pins until the teeth become disposed substantially perpendicular to the base wall of the brackets 31, as shown in FIG. 10.

In this configuration, the sharp corners of the upper horizontal parts of the profiled teeth 35 come into contact with the base wall of the brackets 31, with the result that they are brought to a halt, and consequently any further rotation of the threaded pins 34 causes the profiled teeth 35 to rise, their lower horizontal parts, i.e. those provided with the non-slip lips 35*a*, coming into contact with the lower face of the top 30, so that the box casing 9 becomes rigidly locked against the top 30. This operation is carried out for each locking device. The drip plate 1 is then placed on the box casing 9 and is connected to the box casing 9 by screws 21, one of which is shown in FIG. 6.

The cooking hob is dismantled by a procedure substantially the reverse of that heretofore described.

The invention is not limited to the single embodiment heretofore described, and modifications can be made thereto without leaving the scope of the invention, the basic characteristics of which are summarised in the following claims.

I claim:

1. A vertically thin gas cooking top unit particularly for built-in assembly comprising, a lower box casing having a generally flat bottom, an upper drip plate spaced from the bottom by a distance not greater than three centimeters and defining a verticle space between the drip plate and the bottom, said drip plate having a plurality of spaced apart openings formed therein, a plurality of rigid burner bodies in said space, each burner body having an outlet adjacent a respective opening of the drip plate, means for securing each burner body to said bottom in thermally insulated relation to said bottom, means for securing each burner body to said drip plate adjacent the respective drip plate openings, in thermally insulated relation to the drip plate so that each burner body comprises a rigid connecting bridge between and secured to said bottom and said drip plate and which is thermally insulated from both the drip plate and the bottom, conduits within said space for feeding gas to said burner bodies, and a plurality of gas rings on said drip plate and communicating respectively with the outlets of the respective burner bodies.

2. An improved cooking top as claimed in claim 1, wherein said burner bodies each comprise a hollow body of smoking pipe configuration communicating with a corresponding gas conduit, an outlet mouth of each burner being provided below its outlet with an external flange for fixing to the underside of the drip plate.

3. A cooking top as claimed in claim 2, wherein refractory members are disposed between each burner and the drip plate and comprise a first insulating gasket between the burner flange and the lower face of the drip plate, and a second insulating gasket between the upper face of the drip plate, and a burner head on the drip plate; fastener means for clamping said burner head and said flange together on the drip plate, said insulating gaskets spacing the drip plate from the flange and from the burner head.

4. A cooking top as claimed in claim 3, wherein refractory members are disposed between each burner body and the bottom wall of the box casing, said members for each body being constituted by two ceramic blocks into which free ends of two opposing appendices of a burner body are embedded, and which are individually secured to said bottom wall by a fastener.

5. A cooking top as claimed in claim 8 wherein sides of the box casing are provided with recesses inwardly of the perimeter of the casing, said recesses comprising means for housing coupling means for coupling the cooking top to the top of a planary support.

6. A cooking top as claimed in claim 5, wherein a vertical inner wall of each of said recesses is provided with two upper apertures and a lower centering bore, an upper horizontal wall of said recess comprising a perimetral support edge of the box casing, having a through bore.

7. A cooking hob as claimed in claim 5, wherein each coupling means comprises a thin bodied U bracket extending longitudinally in a horizontal direction, a threaded pin mounted vertically and rotatably through horizontal arms of said bracket and aligned with the through bore provided in the upper horizontal wall of the corresponding recess, and a profiled element in the form of a step, through the upper straight portion of which there is threaded said vertical threaded pin; two hooks on an outer face of a base of said bracket, and a centering stem for insertion into the apertures and into a centering bore of the corresponding recess, the vertical threaded pin being provided with two heads respectively outside of the bracket arms, these heads being each provided with a tool engaging portion, and a rotational stop to stop the profiled element in a correct coupling position, projecting from its bracket.

8. A vertically thin gas cooking top unit particularly for built-in assembly comprising, a lower box casing having a generally flat bottom, an upper drip plate spaced from the bottom and defining a verticle space between the drip plate and the bottom, said drip plate having a plurality of spaced apart openings formed therein, a plurality of rigid burner bodies in said spaces, each burner body having an outlet adjacent a respective opening of the drip plate, means for securing each burner body to said bottom in thermally insulated relation to said bottom, means for securing each burner body to said drip plate in thermally insulated relation to the drip plate so that each burner body comprises a connecting bridge between said bottom and said drip plate which is thermally insulated from both the drip plate and the bottom, conduits within said space for feeding gas to said burner bodies, and a plurality of gas rings on said drip plate and communicating respectively with the outlets of the respective burner bodies, wherein said burner bodies each comprise a hollow body of smoking pipe configuration communicating with a corresponding gas conduit, an outlet mouth of each burner being provided below its outlet with an external flange for fixing to the underside of the drip plate, and wherein refractory members are disposed between each burner and the drip plate and comprise a first insulating gasket between the burner flange and the lower face of the drip plate, and a second insulating gasket between the upper face of the drip plate, and a burner head on the drip plate; fastener means for clamping said burner head and said flange together on the drip plate, said insulating gaskets spacing the drip plate from the flange and from the burner head.

* * * * *